United States Patent [19]

Ito et al.

[11] Patent Number: 4,952,975

[45] Date of Patent: Aug. 28, 1990

[54] IMAGE FORMING APPARATUS CAPABLE OF ACCURATE TROUBLESHOOTING

[75] Inventors: Masazumi Ito; Yoshihiko Yasue, both of Osaka, Japan

[73] Assignee: Minolta Camera Kabushiki Kaisha, Osaka, Japan

[21] Appl. No.: 369,856

[22] Filed: Jun. 22, 1989

[30] Foreign Application Priority Data

Jun. 28, 1988 [JP] Japan ..... 63-159884
Jun. 28, 1988 [JP] Japan ..... 63-159885

[51] Int. Cl.[5] ..... G03G 15/00

[52] U.S. Cl. ..... 355/206; 355/203; 355/205

[58] Field of Search ..... 355/206, 205, 204, 203, 355/207, 208, 209, 314, 316, 317

[56] References Cited

U.S. PATENT DOCUMENTS 4,260,904 4/1981 Horie et al. ..... 307/113
4,490,035 12/1984 Sugiura ..... 355/206 X
4,496,237 1/1985 Schrow ..... 355/209
4,530,593 7/1985 Kasuya et al. ..... 355/206 X
4,553,830 11/1985 Nguyen ..... 355/209
4,662,740 5/1987 Komori et al. ..... 355/206
4,816,865 3/1989 Hamano ..... 355/206
4,821,070 4/1989 Nakade et al. ..... 355/206
4,873,549 10/1989 Tada et al. ..... 355/206

FOREIGN PATENT DOCUMENTS 0085975 8/1983 European Pat. Off. .

*Primary Examiner*—A. C. Prescott
*Attorney, Agent, or Firm*—Burns, Doane, Swecker & Mathis

[57] ABSTRACT

An image forming apparatus according to the present invention comprises an image forming part for forming images on recording papers, a trouble detection part for detecting troubles in image forming operation and stopping operation of the image forming part in response to trouble detection output, a counter part for counting the number of times of trouble occurrence in response to detection output from the trouble detection part, a mode setting part for allowing operation of the trouble detection part and inhibiting that of the counter part when the specific mode is set.

17 Claims, 10 Drawing Sheets

IMAGE FORMING APPARATUS CAPABLE OF ACCURATE TROUBLESHOOTING

BACKGROUND OF THE INVENTION

1. Field of the Invention

The present invention relates to an image forming apparatus, and more particularly, it relates to troubleshooting in an image forming apparatus such as a copying machine or a printer.

2. Description of the Related Art

Generally provided is an image forming apparatus which comprises means for counting troubles such as paper jams occurring in respective members (parts) of the apparatus.

Such counts are employed as the criteria for recognizing the time for element replacement in the faulty parts, locating defective portions and the like.

Also provided is an image forming apparatus in which a trouble mode is set in response to occurrence of a trouble such as a paper jam, to inhibit operation of the apparatus.

Further provided is an image forming apparatus which can be driven while exposing its internal mechanism through manipulation of prescribed switches, in order to enable observation of its operating state through the exposed internal mechanism. Thus, an expert such as a service man can easily identify the cause of a trouble or the like.

As hereinabove described, the counts of the troubles occurring in the apparatus are important data which are employed as the criteria for recognizing the time for element replacement, locating defective portions and the like.

In order to identify the cause of a trouble, the service man or the like intentionally causes a trouble at need.

In general, such a trouble is counted in addition to true troubles.

However, it is unpreferable to count the trouble as the data providing the criterion for recognizing the time for element replacement or locating a defective portion since the same is intentionally caused by the service man.

On the other hand, further provided is an image forming apparatus which sets a jam mode in response to occurrence of a paper jam state and releases the jam mode in response to a jam mode release command (inputted by a dedicated jam reset switch, for example).

Such a paper jam is counted every occurrence of the jam state, as hereinabove described.

Therefore, if a jammed paper (hereinafter referred to as "jam paper") is not completely removed, the jam state is again detected for the same jam paper following the jam mode release command. That is, jam detection is repeated.

However, the count of paper jams is employed as data for recognizing a portion frequently developing jams etc. Thus, repetition of the detection for the same jam paper is unpreferable for maintenance.

On the other hand, such data of repeated jam detection can be utilized in a different point of view. For example, if such repetition is counted every occurrence, the count serves as the criterion for locating a portion where it is difficult to completely remove the jam paper or removal of the jam paper is frequently forgotten.

SUMMARY OF THE INVENTION

An object of the present invention is to accurately detect troubles in an image forming apparatus.

Another object of the present invention is to obtain trouble detection data useful for maintenance of an image forming apparatus.

Still another object of the present invention is to obtain detection data taking account of troubles in maintenance of an image forming apparatus.

A further object of the present invention is to obtain detection data taking account of a trouble caused by the same jam paper in an image forming apparatus.

In order to attain the aforementioned objects, the inventive image forming apparatus according to the present invention comprises image forming means, trouble detection means, counter means, mode setting means and control means. The image forming means forms images on recording papers. The trouble detection means detects troubles in image forming operation by the image forming means, to stop the operation of the image forming means in response to trouble detection output. The counter means counts the number of times of trouble occurrence in response to detection output from the detection means. The mode setting means sets a specific mode. The control means allows the operation of the trouble detection means and inhibits the operation of the counter means when the specific mode has been set.

The image forming apparatus having the aforementioned structure detects intentionally caused troubles but counts no such troubles when the specific mode is set for maintenance or the like, whereby accurate trouble detection data can be obtained.

In order to attain the aforementioned objects, the inventive image forming apparatus according to an aspect of the present invention comprises image forming means, trouble detection means, first means, input means, reset means and second means. The image forming means forms images on recording papers. The trouble detection means detects troubles in image forming operation by the image forming means. The first means sets a trouble mode and counts up a first counter in response to trouble detection output from the trouble detection means during the operation of the image forming means, to inhibit the operation of the image forming means in the trouble mode. The input means inputs a reset signal. The reset means resets the trouble mode in response to the inputted reset signal. The second means counts up a second counter in response to trouble detection output from the trouble detection means when the reset signal is inputted.

The image forming apparatus having the aforementioned structure counts troubles detected again in resetting of the trouble mode independently of ordinary troubles, whereby trouble detection data useful for maintenance can be obtained.

These and other objects, features, aspects and advantages of the present invention will become more apparent from the following detailed description of the present invention when taken in conjunction with the accompanying drawings.

DESCRIPTION OF THE PREFERRED EMBODIMENT

An embodiment of the present invention is now described.

Description of Arrangement of Switches etc.

Figure 1:
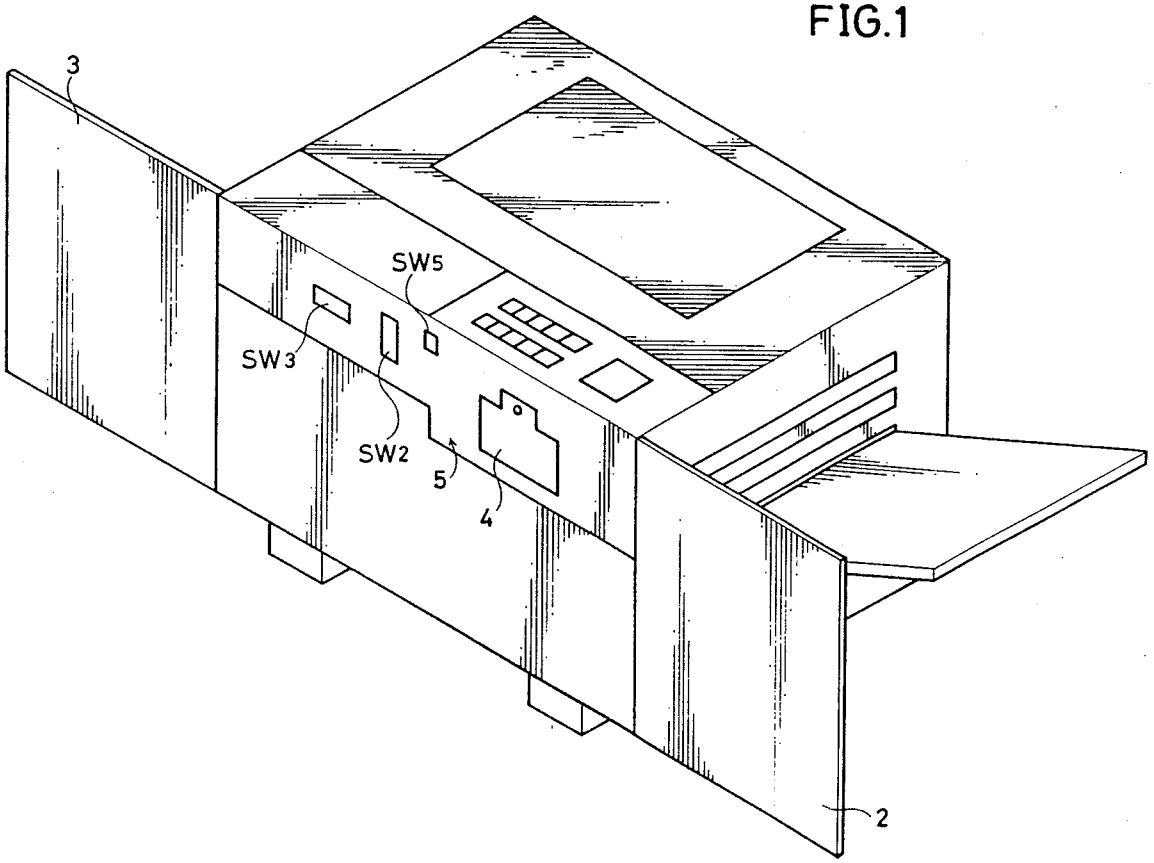
FIG. 1 is a perspective view showing the appearance of a copying machine according to an embodiment of the present invention, with front doors being in opened states.
Figure 2:
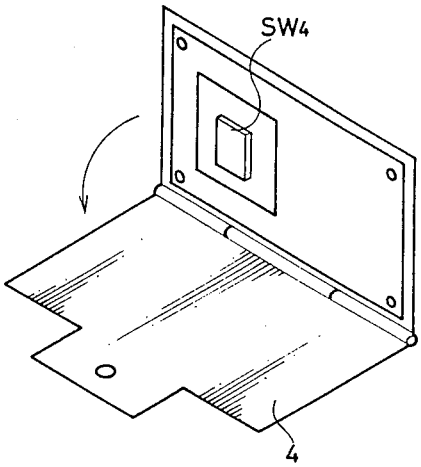
FIG. 2 is an outline perspective view showing a switch SW4 provided within the copying machine shown in FIG. 1, with a door 4 being in an opened state.
Figure 3:
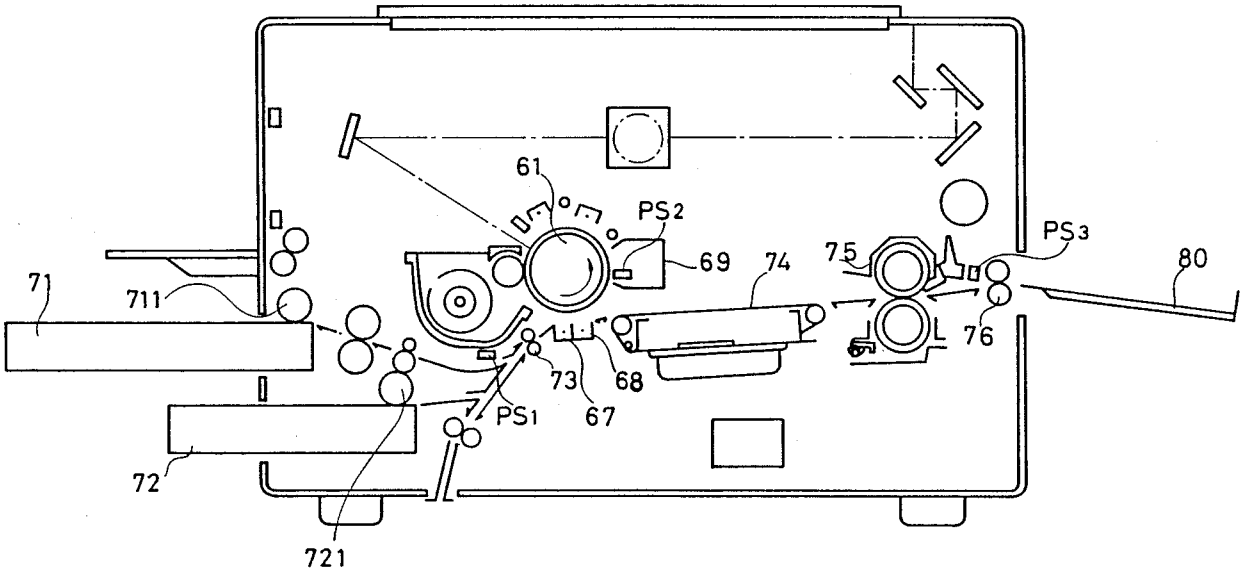
FIG. 3 is a schematic sectional view typically illustrating the internal structure of the copying machine shown in FIG. 1.

FIG. 1 is a perspective view showing a copying machine according to an embodiment of the present invention, FIG. 2 is a perspective view for illustrating arrangement of a switch SW4 in the copying machine and FIG. 3 is a schematic block diagram typically showing the internal structure of the copying machine.

As shown in FIG. 1, a pair of main doors 2 and 3 (illustrated in opened states) are openably and closably provided in front of the copying machine.

Further, a pair of main door switches SW2 and SW3 which are turned on/off following opening/closing of the main doors 2 and 3 and a jam reset switch SW5 for releasing a jam mode are arranged on prescribed positions of an internal frame 5 which is provided in an upper portion of the copying machine.

A subdoor 4 is further provided on a prescribed position of the internal frame 5. As shown in FIG. 2, a subdoor switch SW4 is provided in the subdoor 4 to be turned on/off following opening/closing of the subdoor 4.

The main door 2 is so formed that it is impossible to close the main door 2 in mechanism when the subdoor 4 is in an opened state as shown in FIG. 2. In other words, the switch SW2 is inevitably in an OFF state when the subdoor 4 is in an opened state (ON state of the switch SW4).

Referring to FIG. 3, the internal structure of the copying machine is now described mainly with reference to the structure of a paper feed passage.

The copying machine forms images of light reflected by an original, transmitted from an optical system, on the surface of a photosensitive drum 61 as latent images. The latent images are visualized through toner development and transferred onto copying papers, to be thereafter fixed.

The passage for carrying the copying papers is formed by a paper feed roller 711 or 721, a timing roller 73, a transfer charger 67, a separation charger 68, a carrier belt 74, a fixing unit 75, a discharge roller 76 and the like.

Sensors PS1 and PS3 are provided in prescribed positions of the passage, i.e., positions immediately ahead of the timing roller 73 and the discharge roller 76 respectively. The sensors PS1 and PS3 are adapted to detect passage of the papers.

Further, a sensor PS2 such as a reflection type photosensor is provided in a cleaning unit 69 for removing residual toner from the photosensitive drum 61, in order to detect a paper wound on the photosensitive drum 61.

The copying papers are contained in paper cassettes 71 and 72 in response to sizes thereof.

In synchronization with paper feed timing, a copying paper is drawn out from the paper cassette 71 or 72 by the paper feed roller 711 or 721, and carried to the timing roller 73.

Then the copying paper is fed to a transfer part (between the photosensitive drum 61 and the transfer charger 67) in response to ON timing of the timing roller 73, so that a toner image is transferred to the same.

Thereafter the paper to which the toner image is transferred is separated from the surface of the photosensitive drum 61 by the separation charger 68, and carried to the fixing unit 75 through the carrier belt 74, to be subjected to image fixation. Then the paper is discharged to a tray 80, which is provided in the exterior of the copying machine, by the discharge roller 76.

Description of Electrically Structured Part

Figure 4:
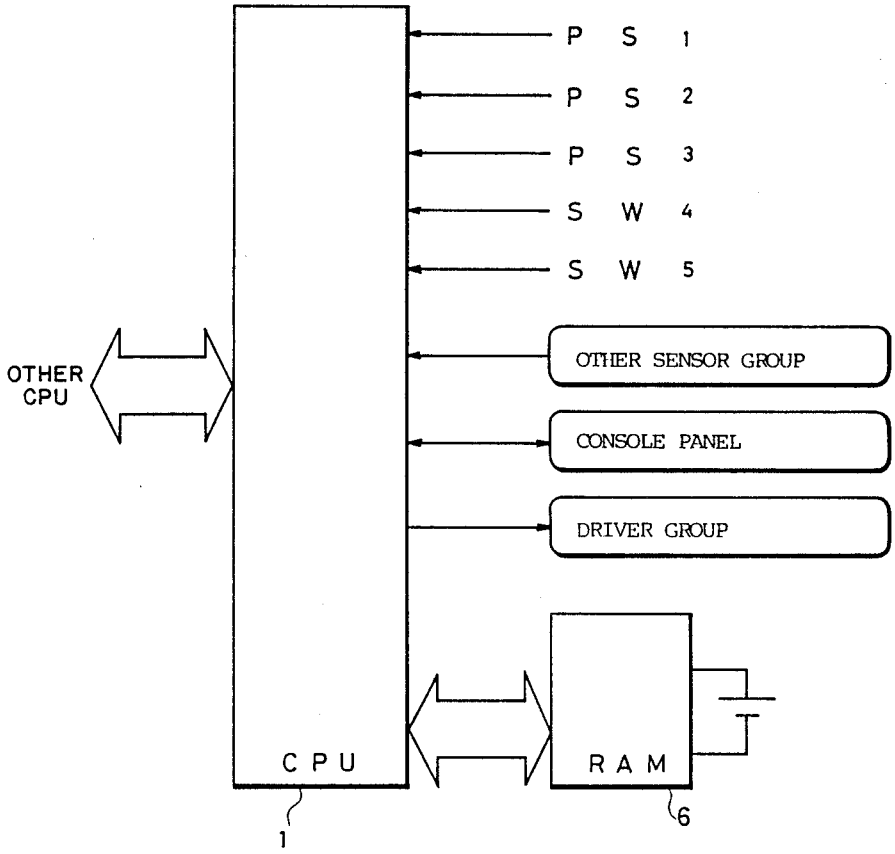
FIG. 4 is a block diagram illustrating the structure of a control circuit provided in the copying machine shown in FIG. 1.

FIG. 4 is a block diagram showing the structure of a control circuit which is provided in the copying machine according to the embodiment of the present invention.

As shown in FIG. 4, the control circuit is mainly formed by a CPU 1.

The CPU 1 is connected with another CPU and a RAM 6 which is backed up by batteries, to control the copying machine while transferring data with these elements. The control operation is hereinafter described in detail on the basis of flow charts.

The CPU 1 receives signals from the sensors PS1, PS2 and PS3, the switches SW4 and SW5, a key switch group of a console panel and other sensor groups.

The CPU 1 outputs driving control signals to a driver group for driving various members provided in the copying machine and to various display elements of the console panel.

Figure 5:
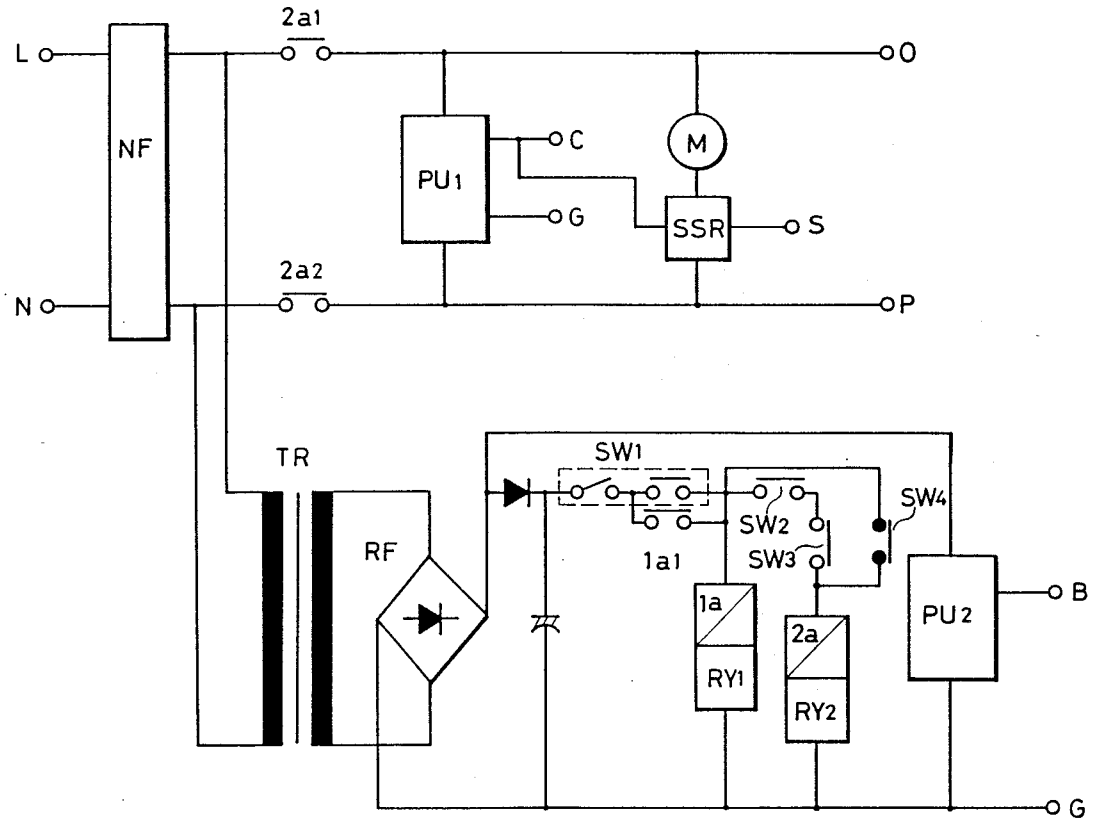
FIG. 5 is a circuit block diagram illustrating the structure of a feeding part of the copying machine shown in FIG. 1.

FIG. 5 is a circuit block diagram showing the structure of a feeding part of the aforementioned copying machine.

In the feeding circuit shown in FIG. 5, source voltage of 100 V, for example, is applied between terminals L and N.

The voltage applied between the terminals L and N is transformed by a transformer TR and rectified by a full-wave rectifier RF, and thereafter outputted as DC 5 V from terminals B and G of a power unit PU2. This output is employed as a driving source for the control CPU, for example.

The voltage applied between the terminals L and N is further applied to a power unit PU1 and a main motor M through relay contacts (normally-closed contacts) 2a1 and 2a2. Output terminals C and G of the power unit PU1 output DC 24 V as a driving source for various members.

When a main switch SW1 is turned on, a relay RY1 is driven to turn on a self holding contact 1a1.

Switches SW2 and SW3 corresponding to the switches SW2 and SW3 shown in FIG. 1 are normally-closed contacts which are in ON states when the main doors 2 and 3 are closed. A switch SW4 corresponding to the switch SW4 shown in FIG. 2 is a normally-opened contact which is in an OFF state when the subdoor 4 is closed.

Consider that the main switch Sw1 is turned on so that the relay RY1 is driven to close the self holding contact 1a1 when the main doors 2 and 3 are closed. Since the contacts of the switches SW2 and SW3 are closed, a relay RY2 is driven to turn on the relay contacts 2a1 and 2a2. Thus, the power unit PU1 is enabled to feed power to various actuators and the main motor M.

When the main doors 2 and 3 are opened in such a state, the contacts of the switches SW2 and SW3 are turned off to cut off power supply to the relay RY2. Thus, the relay contacts 2a1 and 2a2 are turned off to cut off power supply to the actuators and the main motor M from the power unit PU1. Ordinary jam processing (jam processing by a user) is performed in such a state.

However, when a trouble such as a jam is processed by a service man, conditions are different to some extent.

In order to process such a trouble, the service man may wish to observe the operating state of the copying machine, i.e., the state of power supply to the actuators and the main motor M thereby to identify the cause of the trouble.

The switch SW4 is adapted to cope with such case. That is, even if the main doors 2 and 3 are opened, it is possible to feed power to the relay RY2 by opening the subdoor 4 for turning on the switch SW4.

Description of Processing in CPU

The operation of the copying machine according to this embodiment is now described with reference to flow charts showing the processing of the CPU 1. In the flow charts, the term "ON edge" indicates change of state of a switch, sensor, signal or the like from OFF to ON.

(1) Main Routine

Figure 6:
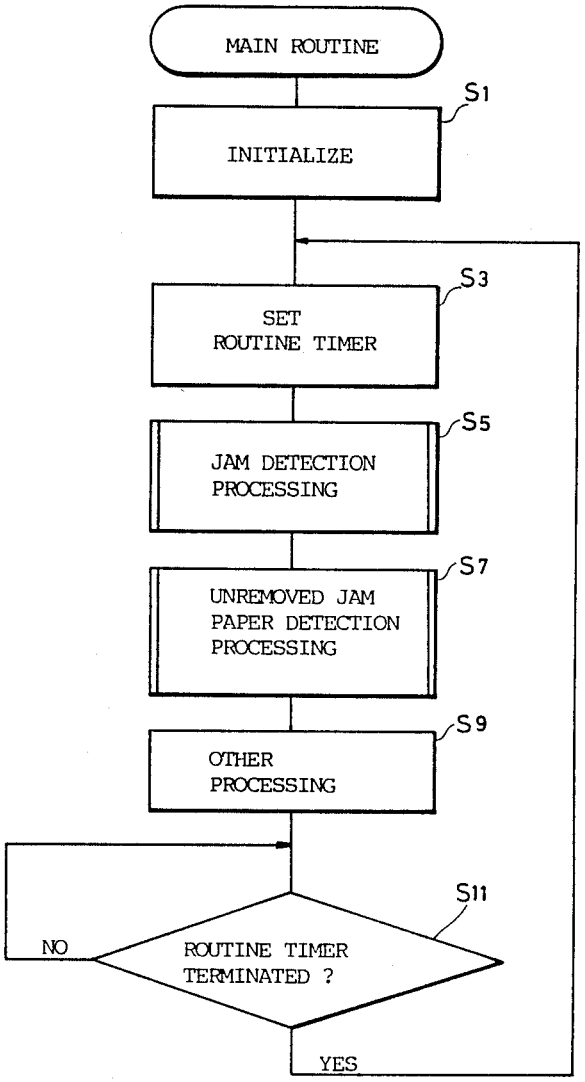
FIG. 6 is a flow chart showing the main routine of processing by a CPU shown in FIG. 4.

FIG. 6 is a flow chart showing the main routine of the processing by the CPU 1.

The CPU 1 starts the processing upon power supply, for example, to execute initialization (step S1).

Then the CPU 1 sets a routine timer for defining the time for one routine at a step S3, calls a jam detection subroutine (step S5) and an unremoved jam paper detection subroutine (step S7), and executes other processing (step S9). The term "other processing" indicates that required for controlling the machine of this embodiment but not directly related to the subject of the present invention, such as processing for controlling a scanning system, a part around the photosensitive drum, the developing unit or the fixing unit.

At a step S11, the CPU 1 waits for termination of the routine timer. Then the process is returned to the step S3, to repeat the processing.

(2) Jam Detection Routine

Figure 7A:
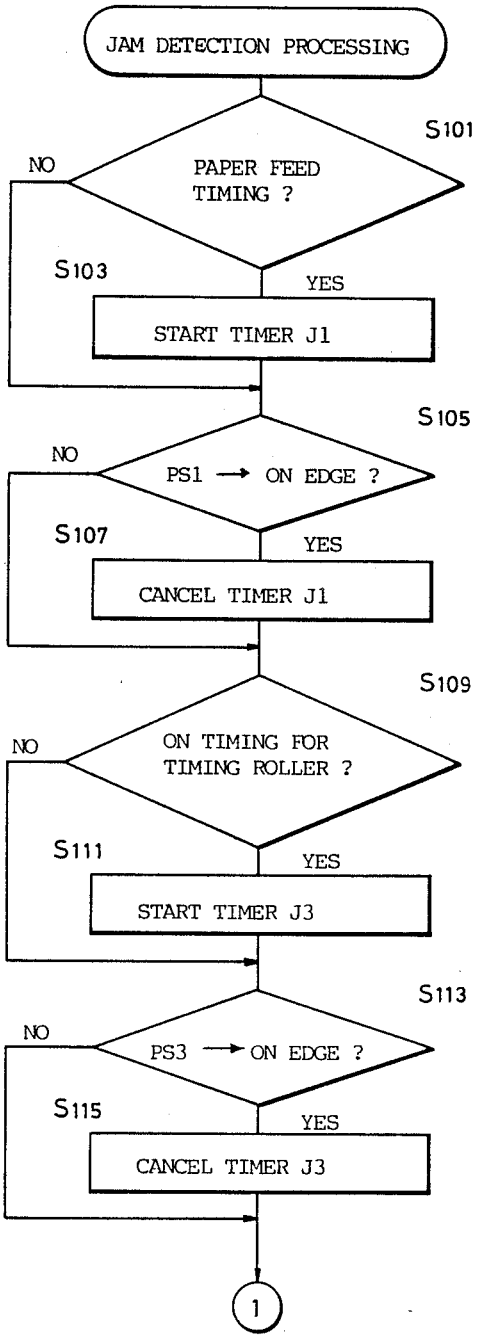
FIGS. 7A and 7B are flow charts showing the content of jam detection processing in FIG. 6.
Figure 7B:
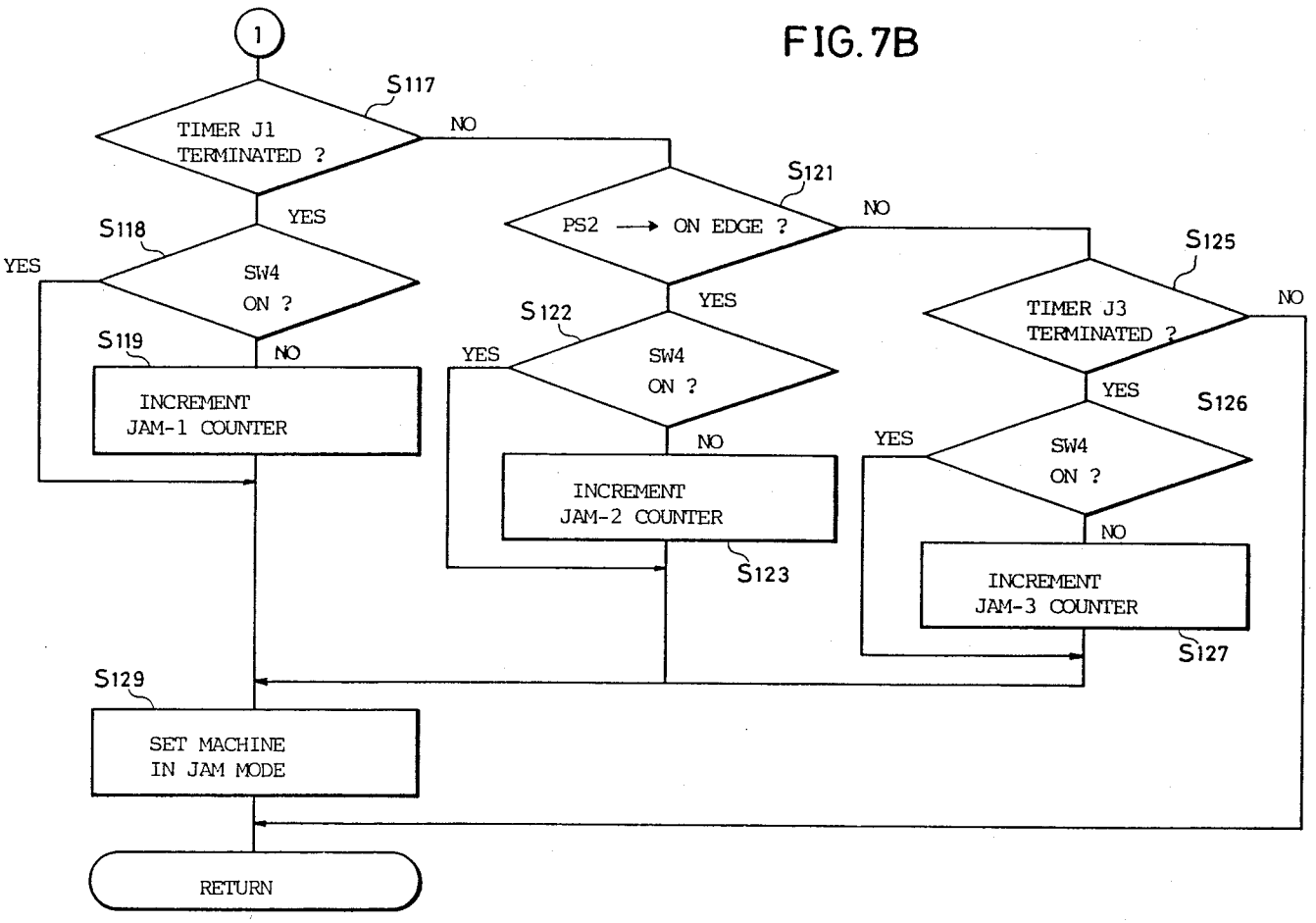

FIGS. 7A and 7B are flow charts showing the jam detection routine (S5) of FIG. 6.

At a step S101, a decision is made as to paper feed timing for feeding a paper from the paper cassette 71 or 72.

If the decision at the step S101 is of YES to indicate paper feed timing, a timer J1 is started (step S103).

The timer J1 is set at a sufficient value for bringing the paper fed from the paper cassette 71 or 72 to the timing roller 73 through the paper feed roller 711 or 721.

This timer J1 is cancelled (step S107) on an ON edge of the sensor PS1 (YES at S105).

In other words, when the forward end of the paper is brought into the position of the sensor PS1 within a prescribed time (defined by the timer J1) upon starting of paper feeding from the paper cassette 71 or 72, it is decided that no jam is caused between the paper feed roller 711 or 721 and the timing roller 73.

At a step S109, a decision is made as to ON timing of the timing roller 73.

If the decision at the step S109 is of YES to indicate the ON timing of the timing roller 73, a timer J3 is started (step S111).

The timer J3 is set at a sufficient value for bringing the paper, which is fed from the timing roller 73 to the transfer part, to the discharge roller 76.

This timer J3 is cancelled (step S115) on an ON edge of the sensor PS3 (YES at S113).

That is, when the forward end of the paper is brought into the position of the sensor PS3 which is provided immediately ahead of the discharge roller 76 within a prescribed time (defined by the timer J3) upon starting of paper feeding from the timing roller 73 to the transfer part, it is decided that no jam is caused between the timing roller 73 and the discharge roller 76.

Steps S117 to S127 are adapted to increment jam counters in response to positions causing jams. The jam counters are retained in the interior of the CPU 1, and incremented by the CPU 1. The count values of the jam counters are stored in the RAM 6.

When the timer J1 is terminated (YES at S117), for example, it indicates occurrence of a jam between the paper feed roller 711 or 721 and the timing roller 73. Therefore, a jam-1 counter is incremented by one at the step S118, on condition that the switch SW4 is in an OFF state (closed state of the subdoor 4: NO at S118). If the switch SW4 is in an ON state, it means that the service man opens the subdoor 4 to test various operating states, and hence no incrementation of the jam-1 counter is executed. That is, the jam-1 counter maintains the current count value, to count no intentional jam.

When an ON edge of the sensor PS2 is detected (YES at S121), it means that a paper is wound on the photosensitive drum 61 after transfer of a toner image. Therefore, a jam-2 counter is incremented by one on the assumption that a jam occurs in the photosensitive drum part (step S123). However, if the switch SW4 is in an ON state (YES at S122), no incrementation of the jam-2 counter is executed for a similar reason to the above.

When the timer J3 is terminated (YES at S125), it indicates occurrence of a jam between the timing roller 73 and the discharge roller 76. Therefore, a jam-3 counter is incremented by one (step S127). However, if the switch SW4 is in an ON state (YES at S126), no incrementation of the jam-3 counter is executed for a similar reason to the above.

After one of the jam counters is incremented, a jam mode is set in the copying machine (step S129).

The jam detection processing is executed in the aforementioned manner.

(3) Unremoved Jam Paper Detection Processing

Figure 8A:
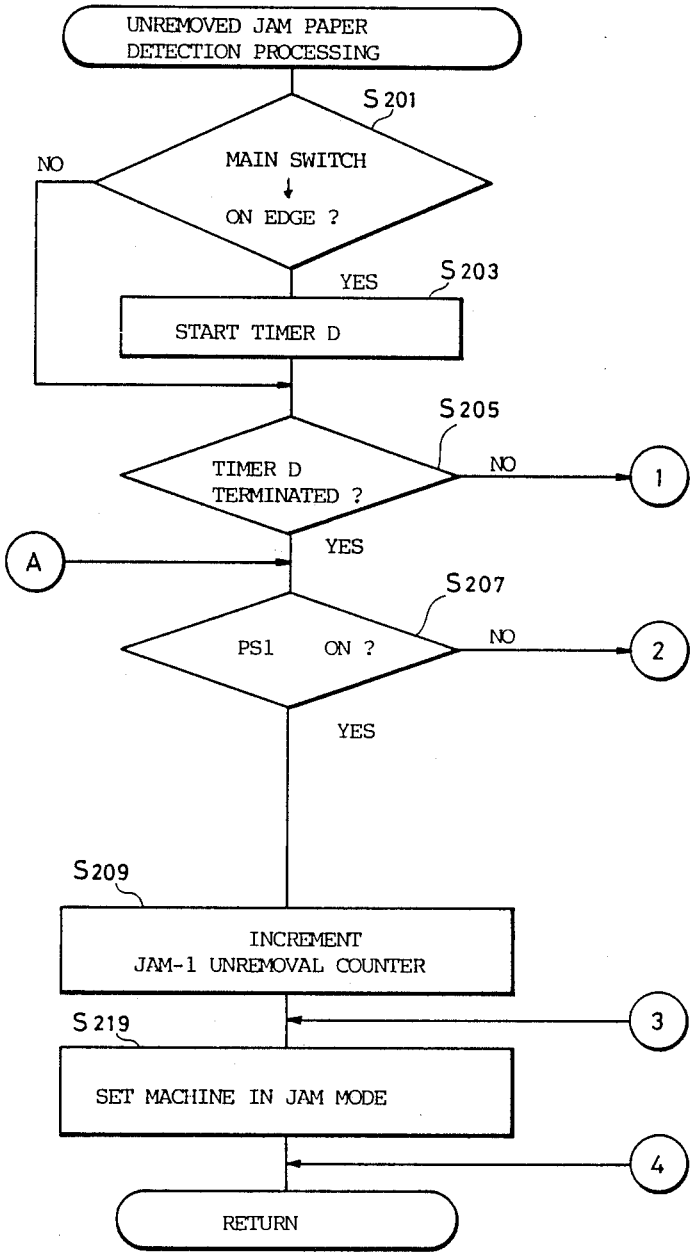
FIGS. 8A and 8B are flow charts showing the content of unremoved jam paper detection processing in FIG. 6.
Figure 8B:
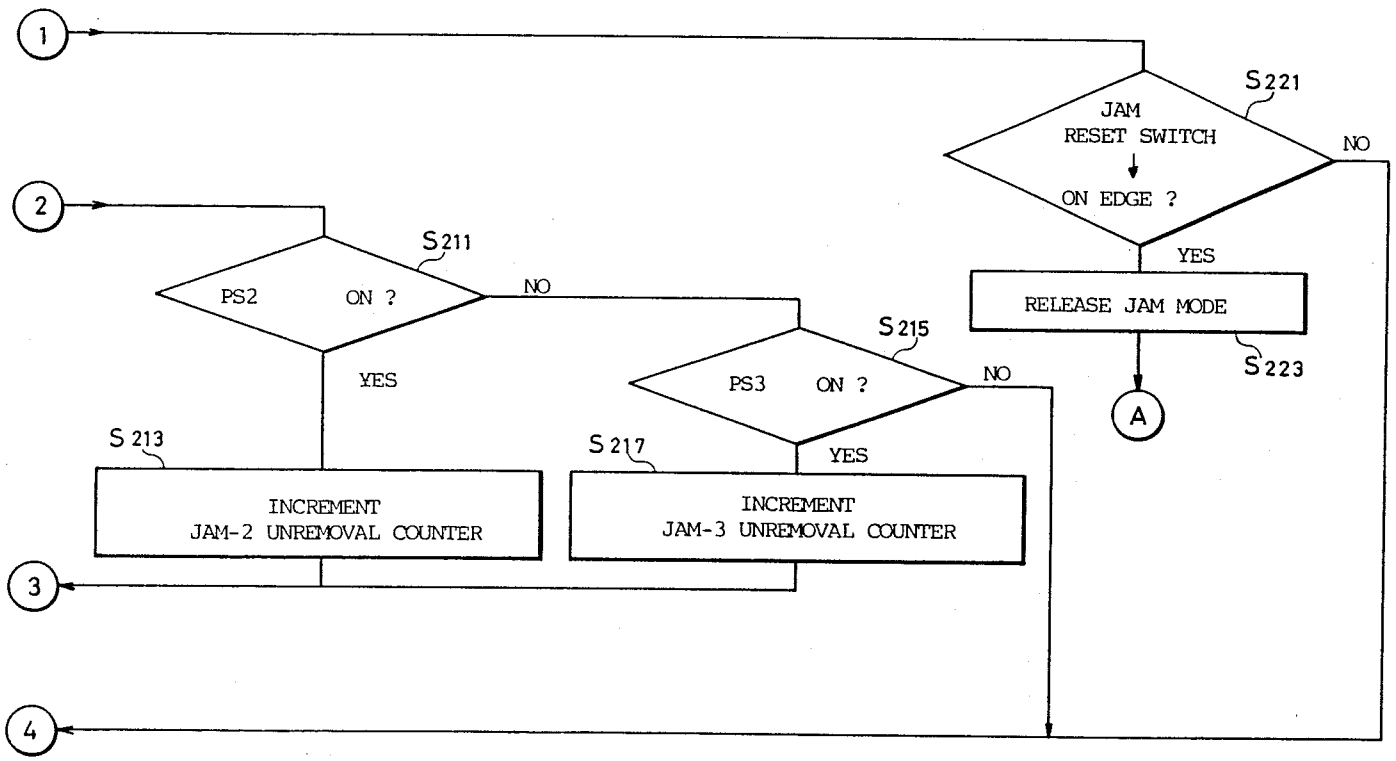

FIGS. 8A and 8B are flow charts showing the unremoved jam paper detection routine (step S7) of FIG. 6.

At a step S201, an ON edge of the main switch Sw1 is decided, to start a timer D at a step S203 if the ON edge is decided at the step S201. The timer D is adapted to cancel erroneous operation in startup times of the sensors PS1 to PS3, and its value is set at about 1 sec., for example.

When the sensor PS1 is in an ON state (YES at S207) at a finish time of the timer D (YES at S205), it means that a paper is left in a position immediately ahead of the timing roller 73, in which the sensor PS1 is arranged. Therefore, a jam-1 unremoval counter is incremented by one (step S209).

Similarly, when the sensor PS2 is in an ON state (YES at S211) at a finish time of the timer D (YES at S205), it means that a paper is wound on the photosensitive drum 61, on which the sensor PS2 is arranged. Therefore, a jam-2 unremoval counter is incremented by one (step S213).

Similarly, when the sensor PS3 is in an ON state (YES at S215) at a finish time of the timer D (YES at S205), it means that a paper is left in a position immediately ahead of the discharge roller 76, on which the sensor PS3 is arranged. Therefore, a jam-3 unremoval counter is incremented by one (step S217).

After one of the aforementioned jam counters is incremented, a jam mode is set in the copying machine (step S219).

Thus, unremoved papers, which are not yet subjected to jam processing, are counted every part.

On the other hand, if a decision of NO is made at the step S205 to indicate that the timer D is not yet terminated, the process is advanced to a step S221, to decide an ON edge of the jam reset switch SW5.

If the ON edge of the jam reset switch SW5 is detected (YES at S221), the jam mode is released (step S223).

Thereafter the process is returned to the step S207, to execute processing for checking the aforementioned respective sensors. Thus, the unremoved papers, which are not yet subjected to jam processing, are also counted every part after input of the jam reset switch SW5, similarly to the above.

The unremoved jam paper detection processing is executed in the aforementioned manner.

Although the above embodiment has been described with reference to a copying machine, the present invention is not restricted to the copying machine but is also applicable to any other apparatus comprising members for feeding, carrying and discharging papers for hard copies.

According to the present invention, troubles occurring in ordinary use of the apparatus are counted but those caused in a temporary released state (forcibly released state) of a trouble mode are not counted.

Therefore, only the count of true troubles can be obtained as trouble count data, to be employed as the criteria for recognizing the time for element replacement and locating defective portions.

According to the present invention, a jam is repeatedly detected for the same jam paper when releasing of a jam mode is commanded by a jam reset switch or the like with respect to an unremoved jam paper. Such repetition is counted every portion of jam detection.

Thus, a criterion for recognizing a portion where it is difficult to completely remove the jam paper or removal of the jam paper is frequently forgotten can be obtained by the result of such counting.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus comprising:

image forming means for forming images on a recording paper;

trouble detection means for detecting troubles in image forming operation by said image forming means to stop the operation of said image forming means in response to the trouble detection output;

counter means for counting the number of times of trouble occurrence in response to the detection output from said trouble detection means;

mode setting means for setting a specific mode; and control means for allowing operation of said trouble detection means and inhibiting operation of said counter means upon setting of said specific mode.

2. An image forming apparatus in accordance with claim 1, wherein said image forming means has a passage for carrying the recording paper, while said trouble detection means has a recording paper detection sensor provided in said passage for detecting recording paper jams and said counter means counts the number of times of detected said recording paper jams.

3. An image forming apparatus in accordance with claim 2, wherein said trouble detection means has a plurality of said recording paper detection sensors and said counter means counts numbers of times of jams corresponding to respective ones of said recording paper detection sensors.

4. An image forming apparatus in accordance with claim 1, further comprising:

a frame enclosing said image forming means, a first door mounted on said frame for exposing said image forming means in an opened state, and a second door provided to be openable only when said first door is opened, wherein said mode setting means being provided inside said second door.

5. An image forming apparatus comprising:

image forming means for forming images on a recording paper;

a frame enclosing said image forming means;

a door mounted on said frame for exposing said image forming means in an opened state;

door detection means for detecting an opened/closed state of said door;

first inhibition means for inhibiting operation of said image forming means in response to the detection output from said detection means indicating an opened state of said door;

trouble detection means for detecting troubles in image forming operation by said image forming means to stop the operation of said image forming means in response to the trouble detection output;

counter means for counting the number of times of trouble occurrence in response to the detection output from said detection means;

mode setting means provided to be capable of on-off operation in the opened state of said door; and second inhibition means for inhibiting operation of said counter means in response to the ON output from said mode setting means, thereby to release the inhibition by said first inhibition means.

6. An image forming apparatus in accordance with claim 5, wherein said image forming means has a passage for carrying the recording paper, while said trouble detection means has a recording paper detection sensor provided in said passage for detecting recording paper jams and said counter means counts the number of times of detected said recording paper jams.

7. An image forming apparatus in accordance with claim 6, wherein said trouble detection means has a plurality of said recording paper detection sensors and said counter means counts numbers of times of jams corresponding to respective ones of said recording paper detection sensors.

8. An image forming apparatus comprising:

image forming means for forming images on a recording paper;

trouble detection means for detecting troubles in image forming operation by said image forming means to stop the operation of said image forming means in response to the trouble detection output;

counter means for counting the number of times of trouble occurrence in response to the detection output from said trouble detection means;

memory means for storing a count value obtained by said counter means;

mode setting means for setting a specific mode; and control means for inhibiting the counting operation of said counter means while maintaining said count value stored in said memory means upon setting of said specific mode.

9. An image forming apparatus in accordance with claim 8, wherein said image forming means has a passage for carrying the recording paper, while said trouble detection means has a recording paper detection sensor provided in said passage for detecting recording paper jams and said counter means counts the number of times of detected said recording paper jams.

10. An image forming apparatus in accordance with claim 8, wherein said trouble detection means has a plurality of said recording paper detection sensors and said counter means counts numbers of times of jams corresponding to respective ones of said recording paper detection sensors.

11. An image forming apparatus comprising:

image forming means for forming images on a recording paper;

trouble detection means for detecting troubles in image forming operation by said image forming means;

first means for setting a trouble mode in response to the trouble detection output from said trouble detection means during the operation of said image forming means and counting up a first counter for inhibiting the operation of said image forming means upon setting of said trouble mode;

input means for inputting a reset signal;

reset means for resetting said trouble mode in response to inputted said reset signal; and second means for counting up a second counter in response to the trouble detection output from said trouble detection means upon input of said reset signal.

12. An image forming apparatus in accordance with claim 11, wherein said image forming means has a passage for carrying said recording papers and said trouble detection means has a recording paper detection sensor provided in said passage for detecting recording paper jams, while said first means sets said trouble mode and counts up said first counter in response to the detection output of recording paper jam from said trouble detection means and said second means counts up said second counter in response to the recording paper detection output from said recording paper detection sensor upon input of said reset signal.

13. An image forming apparatus in accordance with claim 12, wherein said trouble detection means has a plurality of said recording paper sensors, while said first means counts up respective ones of a plurality of said first counters corresponding to respective ones of said recording paper sensors and said second means counts up respective ones of a plurality of said second counters corresponding to respective ones of said recording paper sensors.

14. An image forming apparatus in accordance with claim 11, wherein said second means sets said trouble mode in response to the trouble detection output from said trouble detection means.

15. An image forming apparatus comprising:

image forming means for forming images on a recording paper;

trouble detection means for detecting troubles caused in image forming operation by said image forming means and setting a trouble mode in response to the trouble detection output for inhibiting the operation of said image forming means upon setting of said trouble mode;

first and second counters;

first control means for counting up said first counter in response to the detection output from said trouble detection means;

input means for inputting a reset signal;

reset means for resetting said trouble mode in response to said inputted reset signal; and second control means for counting up said second counter in response to the detection output from said trouble detection means after input of said reset signal.

16. An image forming apparatus in accordance with claim 15, wherein said second control means counts up said second counter without driving said first counter.

17. An image forming apparatus in accordance with claim 15, wherein said first control means counts up said first counter without driving said second counter.

* * * * *